United States Patent [19]

Lang

[11] 4,223,660

[45] Sep. 23, 1980

[54] REMOVABLE OVEN DOOR GASKET

[75] Inventor: Ronald G. Lang, Eastlake, Ohio

[73] Assignee: The Stalwart Rubber Co., Bedford, Ohio

[21] Appl. No.: 11,789

[22] Filed: Feb. 14, 1979

[51] Int. Cl.[3] ..... F24C 15/02

[52] U.S. Cl. ..... 126/190; 277/166; 49/479; 49/482

[58] Field of Search ..... 126/190; 49/189, 479, 49/482, 493, 494; 277/12, 166, 189

[56] References Cited

U.S. PATENT DOCUMENTS

| | | | |
|---|---|---|---|
| 3,029,805 | 4/1962 | Scott | 126/190 |
| 3,404,675 | 10/1968 | Payne | 126/190 |
| 3,765,400 | 10/1973 | Meier et al. | 49/189 X |
| 3,810,483 | 5/1974 | Vonderhaar | 126/190 |

*Primary Examiner*—Robert S. Ward, Jr.
*Attorney, Agent, or Firm*—Meyer, Tilberry & Body

[57] ABSTRACT

An oven door seal of elastomeric material having metal hooks at the ends for mounting it on the door, which hooks are permanently fastened to flanges on the elastomeric material by a crimping operation.

6 Claims, 5 Drawing Figures

FIG. 1
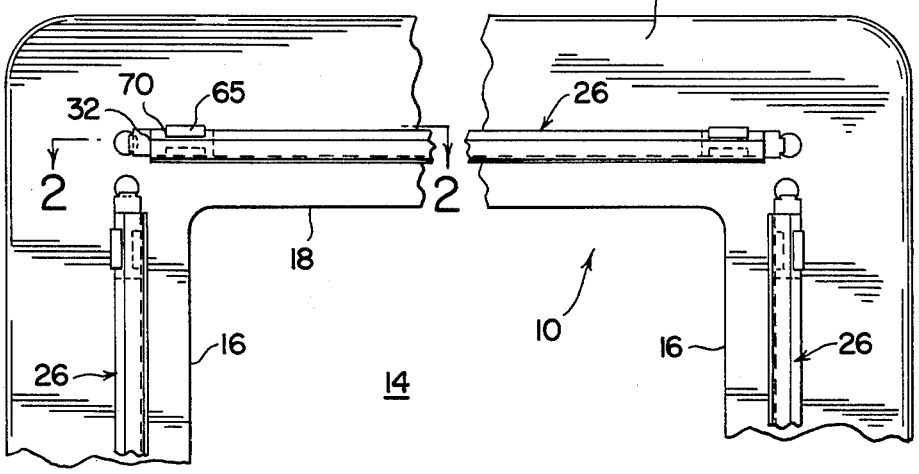
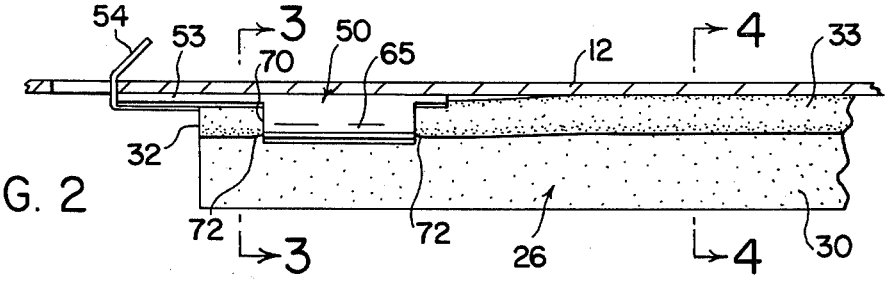
FIG. 2
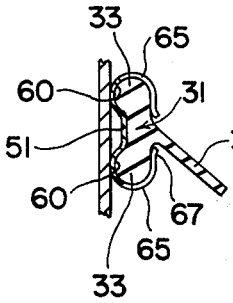
FIG. 3
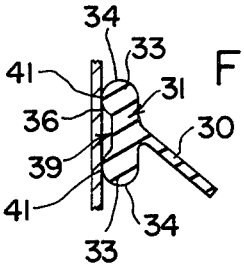
FIG. 4
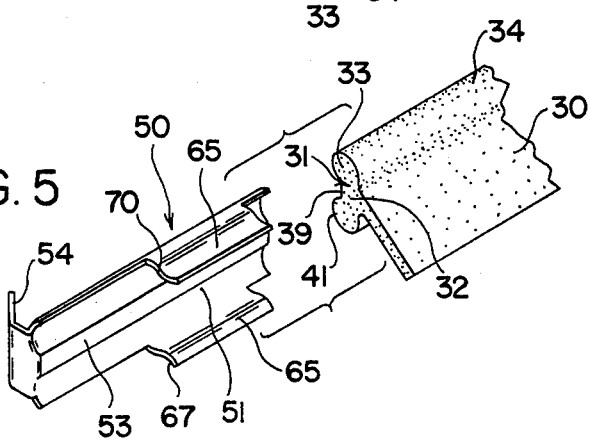
FIG. 5

REMOVABLE OVEN DOOR GASKET

BACKGROUND OF THE INVENTION

The invention herein is concerned primarily with the sealing of the doors of domestic cooking ovens and more specifically to a novel gasket for effecting such sealing.

The invention herein is an improvement over the structures which are disclosed in U.S. Pat. Nos. 3,029,805, 3,404,675, 3,765,400, and 3,810,483. The first of these patents, U.S. Pat. No. 3,029,805, proposed a gasket in the form of an elongate elastomeric member of tubular form having a strip of metal disposed on the interior thereof along the entire length, with protruding offset end tabs adapted to engage in slits formed in the front plane wall of an oven around the oven door opening thereof. The gaskets were supposed to be removable, but problems arose in manipulating these gaskets. The metal strip had to be flexed or bent in the process, as a result of which the gasket was distorted, and often loosened in place thereby weakening the seal. Since the gasket had to be manipulated by the housewife for cleaning, one could not expect that the mechanical dexterity required to assure proper bending and proper flexing would be had by such person.

The second of these patents, U.S. Pat. No. 3,404,675, proposed the use of a short metal insert at each end of the tubular member with an offset tab also adapted to enter slots provided in the oven wall. Since the member was intended to be made from an elastomeric material and hence be stretchable, it could be made slightly shorter than the distance between the slots so that it could be stretched and installed and remain tightly in position under some tension. Removing the gasket for enabling cleaning of the oven surface or to replace the same was also a simple process of stretching the gasket enough to relieve the tension on the tabs and removing the tabs from their slots.

The problem raised by the structure of said U.S. Pat. No. 3,404,675 is how to prevent the short metal inserts from being pulled out of the ends of the tubular gaskets when the gasket is placed in tension. The patent proposes the use of barbs formed on the inserts, facing in such a direction that the insertion of the metal member is readily accomplished, but any attempt to pull the insert out of the ends of the gasket results in the barb points biting into the interior walls of the gasket. This resisted removal.

From a practical standpoint, the conditions needed to achieve the operation described are difficult to meet, if not impossible to achieve. In order to dig into the elastomeric material sufficiently to resist withdrawal, the barbs have to enter so deeply that they protrude from the exterior of the gasket. Likelihood of tearing is present. Shallow barbs will not hold.

The fourth and fifth patents, U.S. Pat. Nos. 3,765,400 and 3,810,483, ostensibly solved the problems by eliminating the need for the barbs. Thus, these patents proposed the use of a metal insert engaged into each open end of the tubular member, which ends were held in place by means of a room temperature vulcanizable adhesive (RTV). The protruding ends of the metal insert had a hook-like configuration adapted to be engaged in suitable perforations formed in the front of the oven wall. Additionally, to assist the adhesive in its holding action, the portion of the metal insert positioned within the open end of the tubular member had through passageways to enhance the bonding of the adhesive within the interior of the tubular member. The gasket was made by dipping the insert portions of the insert into a container of the room temperature vulcanizing adhesive, inserting the same into the ends of the length of the tubular member, and subjecting the resulting assembly to steam for several hours, preferably in an autoclave. This cured the adhesive in moist conditions and was said to form an excellent bond.

Seals for the doors of domestic cooking ovens during the course of their use are subjected to relatively high temperatures, e.g. on the order of 400° to 500° during normal baking operations, and substantially higher temperatures when the oven is one of the self-cleaning types wherein the temperature of the oven is raised to a temperature high enough to substantially burn off the food particles and fats which tend to adhere to the walls of the oven itself.

To resist these elevated temperatures, the elastomeric material is usually a silicon type rubber. RTV's do not adhere well to such rubbers.

Additionally, in practice, it was found that the RTV adhesive disintegrated when repeatedly subjected to these elevated temperatures, with the result that after a relatively short period of time, the insert pulled out of the end of the tubular member, making the gasket entirely unusable.

Thus, the problem of fastening the metal hook to the ends of the rubber sealing portion of a gasket has been a continuing one through the years, and considerable effort, money, and research time has been expended to ultimately solve the problem.

It will be further noted that all such prior art gaskets employed a hollow tube of extruded elastomeric material which for a given sealing action has a much larger cross-sectional area of the expensive elastomeric material than is possible if the gasket were of a solid construction.

THE INVENTION

The present invention contemplates a new and improved gasket of the general type above described which overcomes all of the above referred to difficulties and provides a sealing gasket for oven doors which is simple in construction, more economical to manufacture than the previous designs, and which assures a firm, non-destructible grip between the metal end and the rubber sealing member which will not deterioriate after prolonged use under adverse conditions.

In accordance with the present invention, a strip for sealing the doors of ovens is provided comprised of an elongated member or strip of solid elastomeric material having a generally T-shaped cross-section with the top of the T forming a base engageable against the front plane wall of the oven and the leg of the T forming a flexible lip yieldingly engaging the door of the oven when it is closed, in combination with a metal clip having an elongated base with portions thereof engaging the top surface of the T and extending longitudinally therebeyond, the base engaging portion having a pair of ears folded or crimped around the ends of the top and pressure engaging the underside of the top.

Further in accordance with the invention, the top of the T has a longitudinally extending median arcuate groove, i.e. it is concave in cross-section, and the base portion of the clip has a cross-sectional shape generally conforming to this cross-sectional shape.

The portion of the base portion extending beyond the end of the rubber strip preferably has a reversely bent portion forming a hook engagable in an opening in the oven front wall to maintain the gasket under tension as is conventional in the prior art.

OBJECTS

The principal object of the present invention is the provision of a new and improved oven door gasket of the type including an elongated sealing member of elastomeric material with metal hooks fastened to the ends thereof, which overcomes all of the problems of the prior art, is simple in construction, and economical to manufacture.

Another object of the present invention is the provision of a new and improved oven door gasket of the type described which, for a given length of gasket, employs a lesser amount of elastomeric material.

Another object of the invention is the provision of a new and improved oven door gasket of the general type described wherein repeated applications of heat or tension do not result in loosening of the metal clip relative to the elastomeric material of the gasket.

Another object of the invention is the provision of a new and improved oven door gasket of the general type described which is more economical to manufacture than the previously known oven door gaskets.

A further object of the invention is the provision of a new and improved oven door gasket wherein the number of steps for assembling the gasket with its metal clip are reduced over that of the prior art wherein a room temperature vulcanizable adhesive is employed.

DRAWINGS

The invention may take physical form in certain parts and arrangements of parts, a preferred embodiment of which will be described in detail in this specification and illustrated in the accompanying drawing which forms a part hereof and wherein:

FIG. 1 shows a fragmentary front elevational view of a cooking oven having gaskets connected thereto which are constructed in accordance with the invention.

FIG. 2 is an enlarged fragmentary side elevational view of the gasket of the invention installed on the oven door taken generally on line 2—2 of FIG. 1.

FIG. 3 is a cross-sectional view of FIG. 2 taken approximately on the line 3—3 of FIG. 2.

FIG. 4 is a cross-sectional view of the gasket taken approximately on the line 4—4 of FIG. 2, and FIG. 5 is an exploded enlarged view of the gasket and the metal clip prior to the gasket being assembled with its metal clip.

DESCRIPTION OF THE PREFERRED EMBODIMENT

As is known in the art, a sealing structure for ovens is achieved by means of a plurality of gaskets which are removably secured around the opening of a cooking oven which is to be closed by an oven door. The door is swung into position over the opening, engaging the gaskets around the opening and compressing the same, thereby preventing loss of heat from the oven or the transfer of cold air from the exterior of the oven into the cooking chamber.

Such gaskets are each extensible, comprising lengths of elastomeric material having hook-like structures at their ends which engage in perforations provided in the front wall of the oven. Each blank has a metal member fastened to its end on which the hook-like structures are formed. In accordance with the invention, the metal members are held to the ends of the elastomeric material by means of being crimped around longitudinally extending flanges on the elastomeric material itself.

Referring to the drawings, in FIG. 1 there is illustrated the front of an oven having a front framing wall 12 and provided with a cooking chamber that has an entrance or opening 14 defined by sides 16 and the top and bottom (not shown) edges 18. The wall 12 frames the opening 14. There is a conventional door (not shown) hingedly connected to the front of the oven and suitably sprung by means (not shown) to enable its being swung over the opening 14 to confront the wall 12 or swing away from the opening 14 to give access to the cooking chamber. The exact construction of the door and its mechanism is of no consequence to the invention except for the fact that the interior surface of the door is intended to engage upon the gaskets 26 to be described to be placed around the opening 14.

In FIGS. 1 and 2 gaskets 26 are shown engaged adjacent to sides 16 and adjacent the upper edge 18, these three sides of the opening 14 being the ones usually sealed. Each of the gaskets is constructed in the same manner, the upper gasket usually being somewhat longer than the other two. Each gasket 26 is easily installed or readily removed, for cleaning the surface of the oven 12 or for replacing the gaskets. The manner in which this is done and the construction of the gaskets will now be set forth.

The gasket 26 in the embodiment shown is comprised of an elongated member of elastomeric material such as, for example, silicone rubber or the like, which member in the embodiment shown and in accordance with the invention, has a generally T-shaped cross-sectional shape having a thin leg 30 and a relatively thicker top 31 which in effect forms the base of the gasket itself. This top 31 may generally be described as possessing two flanges 33 extending transversely on both sides of the leg 30 and having edges 34 which are generally circular in cross-section. In the embodiment shown, this top has an outer surface 36 which, when installed, will face and engage the outwardly facing wall 12 of the oven. Thus, the leg 30 extends outwardly away from the wall 12 so that when installed it will be engaged by the door surface and crushed or collapsed to form a tight seal. Any sealing configuration known in the gasket art can be employed, although in the embodiment shown, the leg 30 extends away from the base or top 31 at an angle other than perpendicular. This angle can be more or less than that shown, depending upon the oven on which the gasket is to be installed. The shape shown may be obtained by extruding using any well known technique.

Preferably, and for reasons which will appear, the surface 36 of the top 31 has a longitudinally extending arcuate groove 39 resulting in the top 31 having two spaced generally cylindrical surfaces 41 engaging the surface of the front framing wall 12, as is more clearly shown in FIG. 4.

In accordance with the invention, each end of the elastomeric material has a metal member 50 permanently fastened thereto, each member being in the form of an elongated strip of metal having a base portion 51 adapted to abut against the upper or outer surface of the head 31 and integral therewith portion 53 which extends beyond the end of the elastomeric material and terminates in a reversely bent hook 54, the provision of which hook forms no part of the present invention.

It will be noted that at least the portion 51 has a cross-sectional shape so as to conform to the outer surface 36 of the head 31 generally as is shown in FIG. 3, and thus has a pair of generally cylindrical surfaces 60 which, when the gasket is installed on an oven, engage the outer surface of the framing wall 12.

Importantly, in accordance with the invention, the portion 51 of the metal member 50 has a pair of ears 65 extending in a direction away from the framing wall 12, which ears, when assembled, have a generally cylindrical cross-sectional shape generally conforming to that of the surface 34 of the flanges 33 and engaging the bottom side of the head 31. These ears are crimped downwardly around the flanges 33 with sufficient force and distance that when the crimping force is removed the elastomeric material of the flanges 33 remains in compression. Additionally, the transverse ends of the ears terminate in a slight outward radius 67 so that they do not dig into the rubber and create a stress point which might result in fatigue failure of the rubber under repeated stresses.

In the preferred embodiment the longitudinal ends 70 of the ears 65 adjacent the ends 32 of the top 31 are spaced from such ends generally as is shown in FIGS. 1 and 2 whereby when the ears 65 are crimped around the flanges 33 and the elastomeric material is compressed, there will be a slight bow 72 in the flanges 33 where they exit the space defined by the crimped ears 65.

In the manufacture of the gasket, the extruded elastomeric shape is cut to the desired length. The metal members 50 are stamped to the shape shown in FIG. 5 and are then positioned in a crimping machine. The end of the elastomeric material is then dropped into the channel defined by the two ears 65 with the end 32 of the elastomeric material being spaced from the ends 67 of the ears 65. As the elastomeric material is positioned into this channel, the crimping machine is actuated in a conventional manner to fold the ears 65 over to a degree sufficient that when the crimping force is removed the ears 65 will be pressing firmly against the flanges 33.

It is to be noted that when such a crimping action takes place, the normal tendency is for the transverse mid portion of the base 51 to bow outwardly, but because of the fact that this mid portion already has a longitudinal groove, such bowing has no adverse effect because the depth of the groove is larger than the amount of bowing. Thus, if the mid portion of the groove bends outwardly, it still remains in the shape of a groove and will not engage the surface of the framing wall 12.

With this arrangement, the member 50 engages the front framing wall 12 at two transversely spaced points with the result that it has a substantially increased stability over that which would exist if the mid portion had a convex surface facing the framing wall 12. With the two point or line engagement of the members 50 against this front surface, the cylindrical surfaces 41 of the elastomeric material are held in firm engagement with the front framing surface, and when the oven door is shut the gasket has stability against the torque which would be exerted thereon by forces on the leg 30.

Using the present invention, applicant has been able to manufacture oven door gaskets at a substantial savings in cost over that using a room temperature vulcanizable adhesive, but more importantly the gasket has been able to successfully withstand repeated flexures and repeated heatings to the elevated temperatures normally encountered in oven operation without failure.

The elastomeric material of the present invention has a solid cross-sectional shape. Such a shape gives the same or equivalent sealing action using a lesser amount of elastomeric material than has been the case using gaskets wherein the base was in the shape of a tube so as to receive a metal insert. Also, the longitudinally extending groove 39 in the top 31 also contributes to a reduced amount of elastomeric material as well as providing for stability of the gasket against the surfaces of the oven when torque forces are exerted on the gasket when the oven door is closed.

The invention has been described with reference to a preferred embodiment. Obviously, modifications and alterations will occur to others upon a reading and understanding of this specification. It is my intention to include all such alterations and modifications insofar as they come within the scope of the appended claims.

What is claimed and desired to secure by Letters Patent of the United States is:

1. A gasket for sealing the door of an oven relative to its supporting frame, said gasket being comprised of an elongated member of elastomeric material and a metal hook fastened to each end of said member, said member being generally T-shaped in cross-section with the top surface of the head of the T adapted to face and engage one surface of the oven and with the leg of the T adapted to resiliently engage another surface of the oven when the door is closed, said top being comprised of a pair of flanges, one on each side of said leg, said hook including a base portion abutting against a longitudinal portion of said top surface, and having a pair of ears, one extending around and tightly crimped over the end of each flange, said base portion having a cross-sectional shape conforming to the cross-sectional shape of the top surface of the head of the T, said hook having a reversely bent portion extending away from said surface and adapted to be inserted in an opening in one of the surfaces of the oven for retaining the gasket in position.

2. The gasket of claim 1 wherein the elastomeric material has a longitudinally extending groove in its upper surface and the portion of the hook engaging said upper surface has a similar cross-sectional shape.

3. The gasket of claim 1 wherein the flange ends are generally cylindrical in cross-section and extend beyond the head of the T to form a longitudinally extending groove in the upper surface thereof.

4. The gasket of claim 1 wherein the leg of the T extends at an angle other than 90° away from the head of the T and said leg has a lesser cross-sectional thickness than the head of the T.

5. The gasket of claim 1 wherein the longitudinal ends of said ears are spaced from the longitudinal ends of the elastomeric member.

6. The gasket of claim 3 wherein the ears are generally cylindrical in cross-sectional shape.

* * * * *